US010559288B2

(12) United States Patent
Sargeant

(10) Patent No.: US 10,559,288 B2
(45) Date of Patent: Feb. 11, 2020

(54) STEEL DRUM WITH GREATER RANGE OF NOTES

(71) Applicant: Lawford Sargeant, Niceville, FL (US)

(72) Inventor: Lawford Sargeant, Niceville, FL (US)

( * ) Notice: Subject to any disclaimer, the term of this patent is extended or adjusted under 35 U.S.C. 154(b) by 0 days.

(21) Appl. No.: 15/864,950

(22) Filed: Jan. 8, 2018

(65) Prior Publication Data

US 2019/0213986 A1 Jul. 11, 2019

(51) Int. Cl.
*G10D 13/08* (2006.01)

(52) U.S. Cl.
CPC ..... *G10D 13/08* (2013.01)

(58) Field of Classification Search
CPC ..... G10D 13/08
USPC ..... 84/402; D17/22
See application file for complete search history.

(56) References Cited

U.S. PATENT DOCUMENTS 5,973,247 A * 10/1999 Matthews ..... G10G 5/005 84/402
7,696,421 B1 * 4/2010 Charles ..... G10D 13/08 84/411 R
8,039,721 B2 * 10/2011 Wold ..... G09B 15/02 84/470 R
8,063,296 B2 * 11/2011 Copeland ..... G10H 1/0066 84/645

* cited by examiner

*Primary Examiner* — Jianchun Qin
(74) *Attorney, Agent, or Firm* — J. Nevin Shaffer, Jr.

(57) ABSTRACT

A steel drum for playing soprano music comprising a circular steel drum having a concave surface with an associated steel skirt extending downward from a rim. A stand associated with the steel drum, said steel drum suspended from the stand by at least two non-rigid attachment. The steel drum comprising at least 14 note areas adjacent to and around the rim, a plurality of other note areas distributed over the concave surface below the rim, with at least two octaves available for each note.

10 Claims, 2 Drawing Sheets

STEEL DRUM WITH GREATER RANGE OF NOTES

CROSS-REFERENCE TO RELATED APPLICATION(S)

None.

BACKGROUND OF THE INVENTION

1. Field of Invention

The present invention relates to the field of steel drums, more particularly to a free standing drum able to play music of a soprano instrument.

2. Description of Related Art

Steel drums, also called steel pans, are widely used to play Caribbean and Jamaican music. Steel drums originated in Trinidad and Tobago in the Caribbean. Steel pan musicians are generally called pannists, and modern steel drums is a chromatically pitched percussion instrument typically made from the cutoff bottoms of used 55 gallon industrial drums.

A steel drum more correctly can be referred to as a steel pan or pan as it properly is a part of idiophone family of musical instruments. Thus, it technically is not a drum, which is classified as a membranophone. Steel pans are uniquely made to play in the Pythagorian musical cycle of fourths and fifths.

Steel drums are played using a pair of straight sticks tipped with rubber. The size and type of rubber tip varies according to the class of pan being played, and some musicians use four sticks; two sticks in each hand.

Steel drums constructed using sheet metal with a thickness between 0.8 and 1.5 mm (1/32" and 1/16"). Historically, oil barrels were used to construct steel drums. More recently, many instrument makers have resonance bodies manufactured according to their desired preferences and technical specifications.

The sheet metal is stretched into a bowl shape, referred to commonly as "sinking". Typically, this done with hammers either manually or using air pressure. The bowl shape is marked with round or oval note patterns on the concave surface of the bowl, and the notes of different sizes are shaped and molded into the surface. A tempering process is then performed, and afterward the notes must be softened and an initial tuning performed. The initial tuning process requires softening and then tuning using a tuning device. A tuning technician will use the best possible tuning device to tune each playing area with the right notes and pitch desired. The note's size corresponds to the pitch; larger the oval the lower the tone.

Size of the instrument varies from one drum to the next and may have almost all of the "skirt" (the cylindrical part of the oil drum) cut off with about 30 soprano-range notes. The length of the skirt generally corresponds to the high or low range of the drum. Drums can be painted or chrome plated. Other processes such as nickel plating, powdercoating, or hardening can also be applied.

There are a number of limitations on current steel drums/pans. Generally, prior art drums are 22" in diameter, limiting them to 12 notes on the outer ring and 28 to 30 total. There is also a limited number of octaves, with only two octaves available above on the first four notes, limiting the range. Furthermore, to accommodate most scores, a musician must transpose the music or change key.

Based on the foregoing, there is a need in the art for a new steel drum with more notes, a greater range, and able to avoid transposing the music or change key.

SUMMARY OF THE INVENTION

A steel drum for playing soprano music comprising a circular steel drum having a concave surface with an associated steel skirt extending downward from a rim. A stand associated with the steel drum, said steel drum suspended from the stand by at least two non-rigid attachment. The steel drum comprising at least 14 note areas adjacent to and around the rim, a plurality of other note areas distributed over the concave surface below the rim, with at least two octaves available for each note.

The total note areas comprise at least 37 notes.

The note areas include flat and sharp notes.

The note areas comprise three octaves above middle C.

The note areas comprise perfect 4ths clockwise.

The note areas comprise perfect 5ths counter-clockwise.

The lowest note area comprises a C note at approximately 261 Hz.

The steel drum comprises a diameter of about 24".

The steel skirt extends downward about 8".

The foregoing, and other features and advantages of the invention, will be apparent from the following, more particular description of the preferred embodiments of the invention, the accompanying drawings, and the claims.

BRIEF DESCRIPTION OF THE DRAWINGS

For a more complete understanding of the present invention, the objects and advantages thereof, reference is now made to the ensuing descriptions taken in connection with the accompanying drawings briefly described as follows.

DETAILED DESCRIPTION OF PREFERRED EMBODIMENTS

Figure 1:
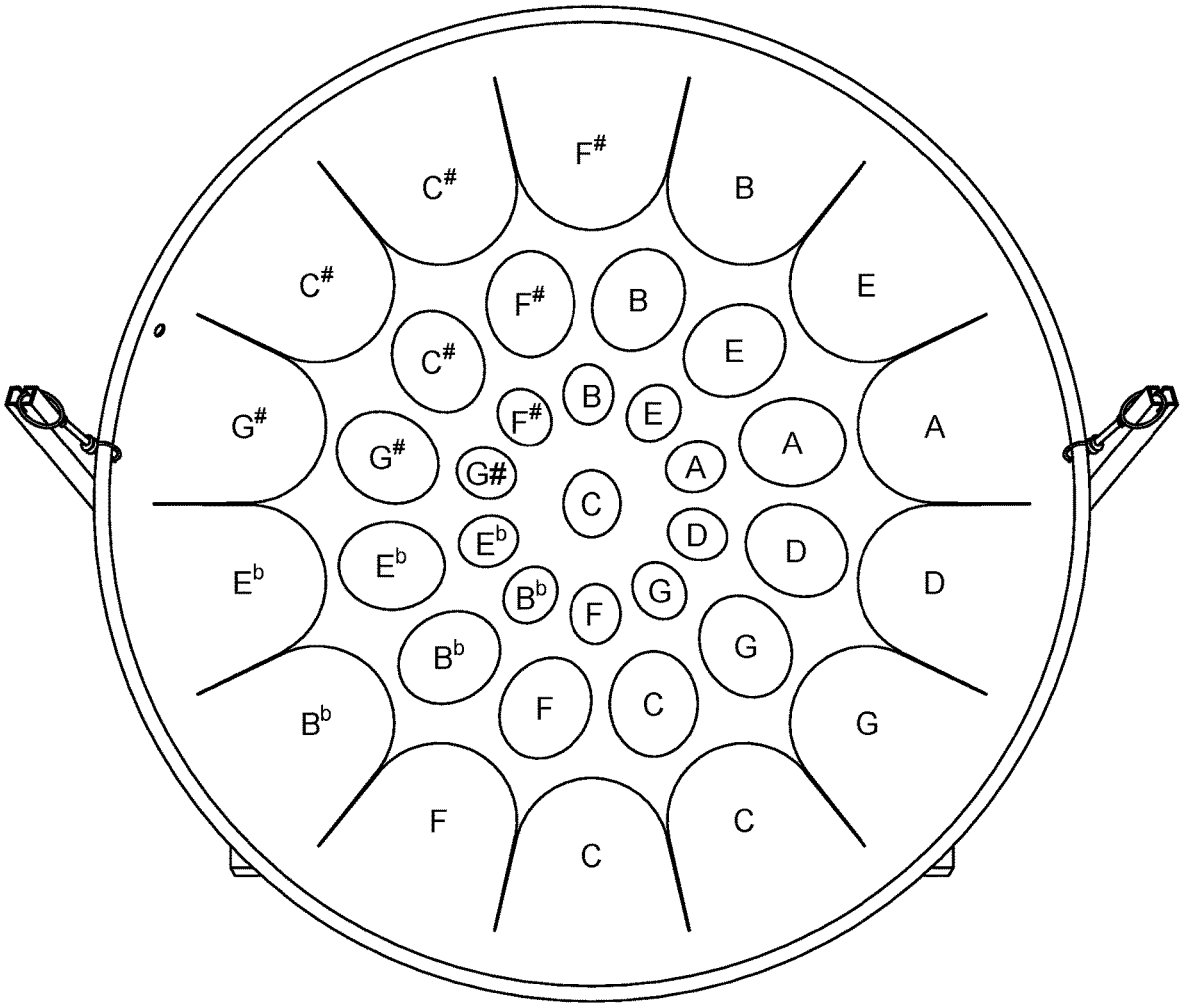
FIG. 1 is a top view of the steel drum, according to an embodiment of the present invention.
Figure 2:
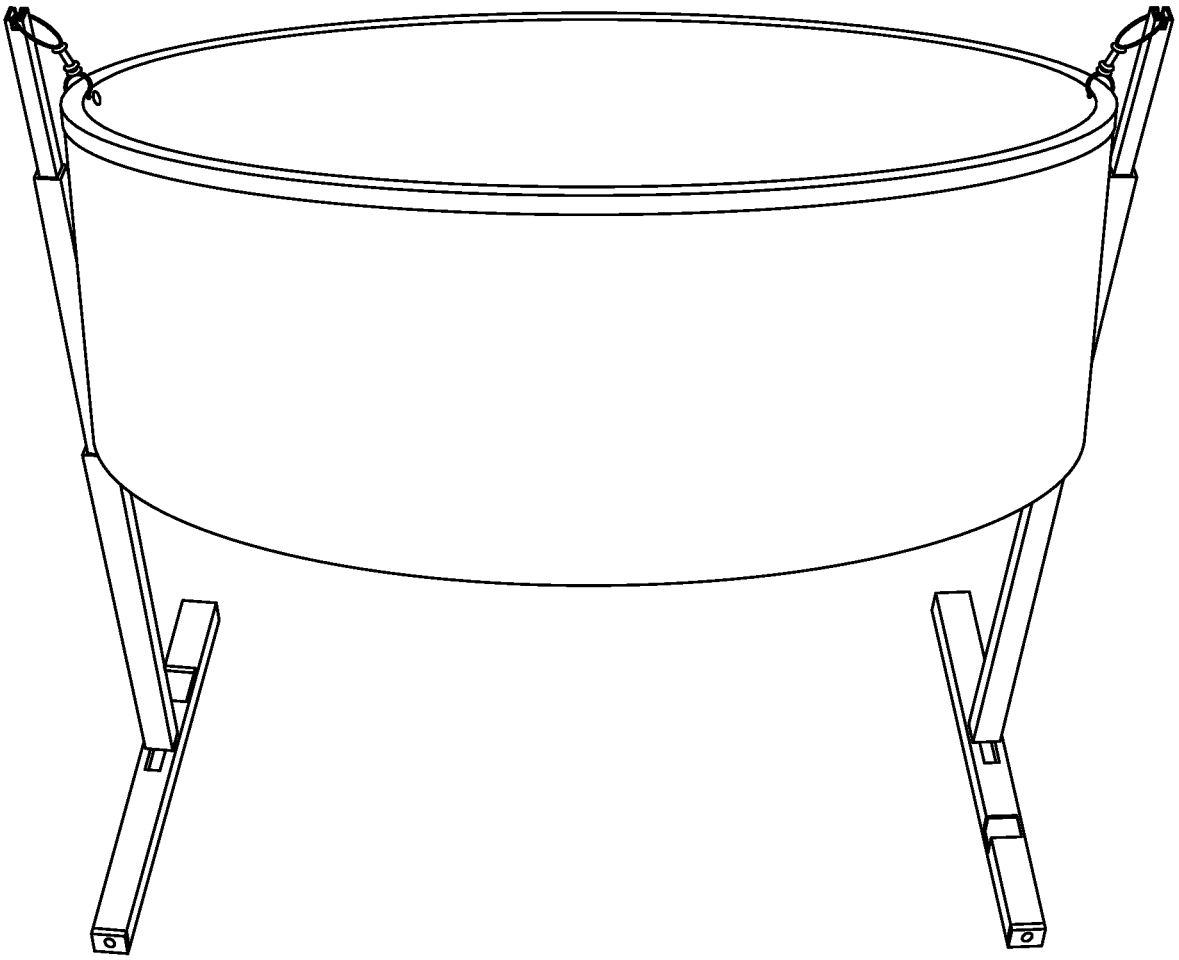
FIG. 2 is a side view of the steel drum, according to an embodiment of the present invention.

Preferred embodiments of the present invention and their advantages may be understood by referring to FIGS. 1-2, wherein like reference numerals refer to like elements.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are numerous modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will now be described in detail with reference to embodiments thereof as illustrated in the accompanying drawings.

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this Application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The Applicants hereby give notice that new Claims may be formulated to such features and/or combinations of such features during the prosecution of the present Application or of any further Application derived therefrom.

References to "one embodiment," "an embodiment," "example embodiment," "various embodiments," etc., may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

Headings provided herein are for convenience and are not to be taken as limiting the disclosure in any way.

The enumerated listing of items does not imply that any or all of the items are mutually exclusive, unless expressly specified otherwise.

The terms "a", "an" and "the" mean "one or more", unless expressly specified otherwise.

Devices or system modules that are in at least general communication with each other need not be in continuous communication with each other, unless expressly specified otherwise. In addition, devices or system modules that are in at least general communication with each other may communicate directly or indirectly through one or more intermediaries.

A description of an embodiment with several components in communication with each other does not imply that all such components are required. On the contrary a variety of optional components are described to illustrate the wide variety of possible embodiments of the present invention.

As is well known to those skilled in the art many careful considerations and compromises typically must be made when designing for the optimal manufacture of a commercial implementation any system, and in particular, the embodiments of the present invention. A commercial implementation in accordance with the spirit and teachings of the present invention may configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

The present invention will now be described in detail with reference to embodiments thereof as illustrated in the accompanying drawings.

FIG. 1 shows a top view of a steel drum with the areas of the musical notes depicted. The steel drum can be of about 24" in diameter with the top surface exhibiting a concave, bowl shaped curve. As can be seen, the outer surface at the rim accommodates at least 14 notes. Notes include C, D, E, F, G, A, and B as well as sharp or flat notes as shown, with 37 notes total. Two octaves above each note are provided, with three octaves above middle C provided. The steel drum accommodates perfect 4ths clockwise and perfect 5ths counter-clockwise.

In an embodiment, the steel drum exhibits a lowest note starting at C4 at 261.626 Hz, A4 at 440 Hz, C5 at 523.251 Hz, C6 at 1046.50 Hz, and 2093.00 Hz.

FIG. 2 shows a perspective side view of the steel drum. A stand with two vertical supports in opposing configuration. The steel drum hangs from the two vertical supports using fiber twine, rope, ribbons, lacing, leather ties/tabs, or the like to suspend the steel drum. This permits free vibration of the steel drum when struck to generate sound unimpeded by damping that otherwise would occur if some type of rigid mounting to the stand were used. Also, as seen, a steel skirt extends about 8" downward from the rim at the edge of the drum.

Advantages offered by the steel drum disclosed herein include less need to transpose/change key during a performance. Because of more notes, the player has a wider range on the drum to perform the music of a soprano instrument. As such, the disclosed steel drum functions more reliably and properly as a soprano instrument.

The invention has been described herein using specific embodiments for the purposes of illustration only. It will be readily apparent to one of ordinary skill in the art, however, that the principles of the invention can be embodied in other ways. Therefore, the invention should not be regarded as being limited in scope to the specific embodiments disclosed herein, but instead as being fully commensurate in scope with the following claims.

I claim:

1. A steel drum for playing soprano music, comprising:

a. a single circular steel drum having a concave surface with notes placed in the order of 4ths and 5ths, with an associated steel skirt extending downward from a rim; and b. a stand associated with the steel drum, said steel drum suspended from the stand by at least two non-rigid attachments;

c. the single circular steel drum comprising at least 14 note areas adjacent to and around the rim on the concave surface wherein the at least 14 note areas consist of at least twelve root notes and two octaves C and C♯ adjacent said root notes, and a plurality of other note areas distributed over the concave surface below the rim, with at least two octaves available for each root note.

2. The steel drum for playing soprano music of claim 1, wherein the total note areas comprise at least 37 notes.

3. The steel drum for playing soprano music of claim 1, wherein the note areas include flat and sharp notes and natural notes including the diatonic scale C D E F G A B C and the accidentals C♯ Eb F♯ G♯ and Bb.

4. The steel drum for playing soprano music of claim 1, wherein the note areas comprise three octaves above middle C.

5. The steel drum for playing soprano music of claim 1, wherein the note areas comprise perfect and inverted 4ths clockwise.

6. The steel drum for playing soprano music of claim 1, wherein the note areas comprise perfect and inverted 5ths counter-clockwise.

7. The steel drum for playing soprano music of claim 1, wherein the lowest note area comprises a C note at approximately 261 Hz.

8. The steel drum for playing soprano music of claim 1, wherein the single circular steel drum comprises a diameter of about 24" such that fourteen notes are located adjacent the rim and twenty-three notes are located below the fourteen notes and in the concave surface.

9. The steel drum for playing soprano music of claim 1, wherein the skirt extends downward at least 8".

10. A steel drum for playing soprano music, comprising:

a. a single circular steel drum having a concave surface with notes placed in the order of 4ths and 5ths, with an associated steel skirt extending downward from a rim wherein the single circular steel drum comprises a diameter of about 24" such that fourteen notes are located adjacent the rim and twenty-three notes are located below the fourteen notes and in the concave surface;

and b. a stand associated with the steel drum, said steel drum suspended from the stand by at least two non-rigid attachments;

c. the single circular steel drum comprising at least 14 note areas adjacent to and around the rim on the concave surface wherein the at least 14 note areas consist of at least twelve root notes and two octaves C and C♯ adjacent said root notes, and a plurality of other note areas distributed over the concave surface below the rim, with at least two octaves available for each root note; wherein the note areas include flat and sharp notes and natural notes including the diatonic scale C D E F G A B C and the accidentals C♯ Eb F♯ G♯ and Bb; wherein the note areas comprise three octaves above middle C; wherein the note areas comprise perfect and inverted 4ths clockwise; wherein the note areas comprise perfect and inverted 5ths counter-clockwise; wherein the lowest note area comprises a C note at approximately 261 Hz.

* * * * *